US011795737B2

(12) United States Patent
Underwood et al.

(10) Patent No.: US 11,795,737 B2
(45) Date of Patent: Oct. 24, 2023

(54) LOCK ASSEMBLY FOR SLIDING DOOR LATCH

(71) Applicant: Kason Industries, Inc., Newnan, GA (US)

(72) Inventors: Jeffrey E. Underwood, Newnan, GA (US); Brett A. Mitchell, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 1125 days.

(21) Appl. No.: 16/377,652

(22) Filed: Apr. 8, 2019

(65) Prior Publication Data

US 2020/0318398 A1 Oct. 8, 2020

(51) Int. Cl.

| | |
|---|---|
| ***E05B 65/08*** | (2006.01) |
| ***E05B 77/14*** | (2014.01) |
| ***E05B 79/04*** | (2014.01) |
| *E05B 15/04* | (2006.01) |

(52) U.S. Cl.

CPC ..... *E05B 77/14* (2013.01); *E05B 65/0888* (2013.01); *E05B 79/04* (2013.01); *E05B 2015/0437* (2013.01)

(58) Field of Classification Search

CPC ..... E05B 77/14; E05B 65/0888; E05B 79/04; E05B 2015/0437; E05B 13/004; E05B 47/0004; E05B 65/0811; E05B 47/0046; E05B 83/04; E05C 17/60

See application file for complete search history.

(56) References Cited

U.S. PATENT DOCUMENTS

2003/0015879 A1* 1/2003 Finkelstein ..... E05B 83/04 292/213

* cited by examiner

*Primary Examiner* — Kristina R Fulton
*Assistant Examiner* — Thomas L Neubauer
(74) *Attorney, Agent, or Firm* — Baker Donelson Bearman Caldwell & Berkowitz, PC

(57) ABSTRACT

A lock and strike assembly is disclosed which is coupled to a latch assembly for a sliding door. The latch assembly includes a movable tongue or latch bar with two oppositely disposed catches. The lock assembly includes a housing, a solenoid housing having a solenoid coupled to a d.c. power source and controlling electronics. The solenoid is coupled to a trapezoidal shaped dog which is pivotally coupled to the solenoid housing for reciprocal movement between an engaged position and a disengaged position. The strike assembly is mounted to the lock assembly for locking engagement with the catch of the latch assembly.

12 Claims, 8 Drawing Sheets

LOCK ASSEMBLY FOR SLIDING DOOR LATCH

TECHNICAL FIELD

This invention relates to door locks, and particularly to automatic locking assemblies for a sliding door latch such as those employed on trucks and vans.

BACKGROUND OF THE INVENTION

Package delivery trucks, which have also been referred to as panel trucks and vans, typically have one or more sliding doors. By gripping a door handle on the inside or outside, the door may be manually moved between positions closing and opening a doorway in the truck body. These doors typically have a latch coupled with the two handles which holds the door in a fully opened or fully closed position by engagement with strikes mounted adjacent each end of the door run above its track. The door in its closed position may thus be unlatched and slid open from either side of the door by rotation and pulling the inside or outside handle.

For security these latches have also been provided with manually operable inside locks which prevent the door from being opened from the outside while a worker is inside. This has commonly been in the form of a lock bar that may be moved into and out of locking engagement with an internal cam that is operated by the outside handle that cams the latch out of latching engagement with a strike.

A persistent problem associated with these sliding door latches has been the accidental unlatching of the door latch caused by an abrupt upward movement of the vehicle.

Thus there has long existed a need for a sliding door latch with an inside lock that has means for automatically locking the latch upon the latch being engaged with the latch strike. It is to the provision of such that the present invention is primarily directed.

SUMMARY OF THE INVENTION

A door latch locking assembly for use with a latch assembly having a vertically movable latch tongue, the locking assembly comprises a lock housing, a strike coupled to the lock housing for engagement with the latch tongue, a solenoid coupled to the lock housing, and a pivotal dog coupled to the solenoid for pivotal movement between an engaged position positioned closely adjacent and over the latch assembly latch tongue and a disengaged position positioned distal the latch assembly latch tongue.

DETAILED DESCRIPTION

Figure 1:
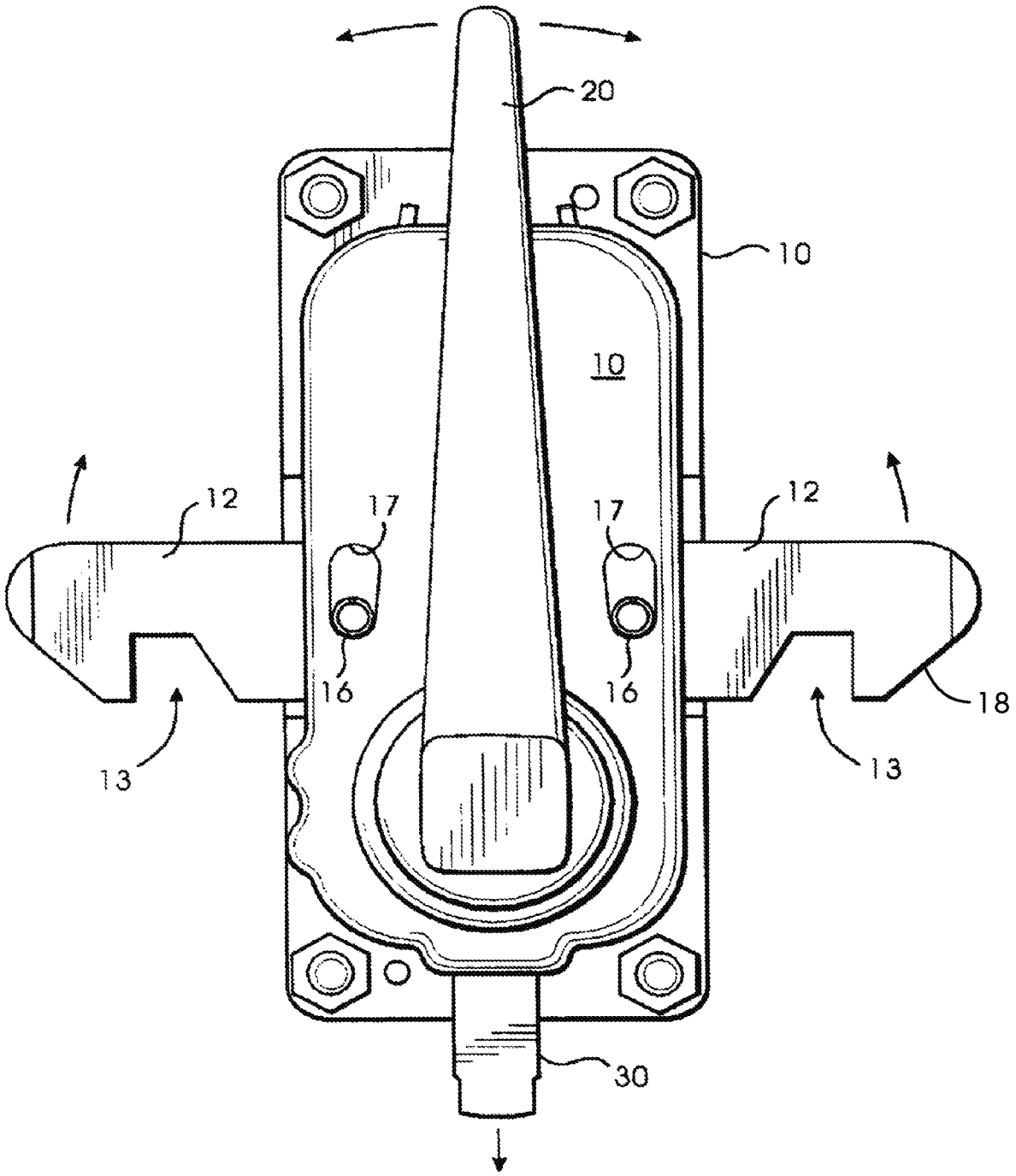
FIG. 1 (Prior Art)
FIG. 1 is an inside face view of a prior art latch assembly, shown in a latch locked position.

With reference next to the drawings, there is shown a latch or latch assembly 5 coupled to a lock assembly 6 having a strike assembly 7 for a sliding door.

The latch assembly 5 includes a latch housing 10 to which a movable tongue or latch bar 12 is mounted for pivotal or floating vertical movement. The latch bar 12 is seen to extend laterally through and to each side of the housing 10 and to be formed with two catches 13 adjacent its two opposite ends. The latch bar is movably mounted to the housing by a center pin 14 that extends through a housing slot 15 and by two roll pins 16 that extend through two other slots 17 that straddle slot 15. Since all of these pins are smaller than their slots, the latch bar has some limited freedom of movement with respect to the housing. Two compression springs 18 are mounted to opposite sides of the center pin 14 and bias the latch bar 12 downwardly bringing those pins into contact with the bottom of the slots 15 and 17. Thus, the latch bar may be lifted slightly as well as rotated about the center pin a little as its beveled ends or sloped surfaces 18 engage a strike in causing either end to be cammed upwardly in seating one of its catches 13 on a strike. The strikes, described in more detail hereinafter, are mounted to both sides of the track on which a sliding door equipped with the latch is mounted to run.

Figure 2:
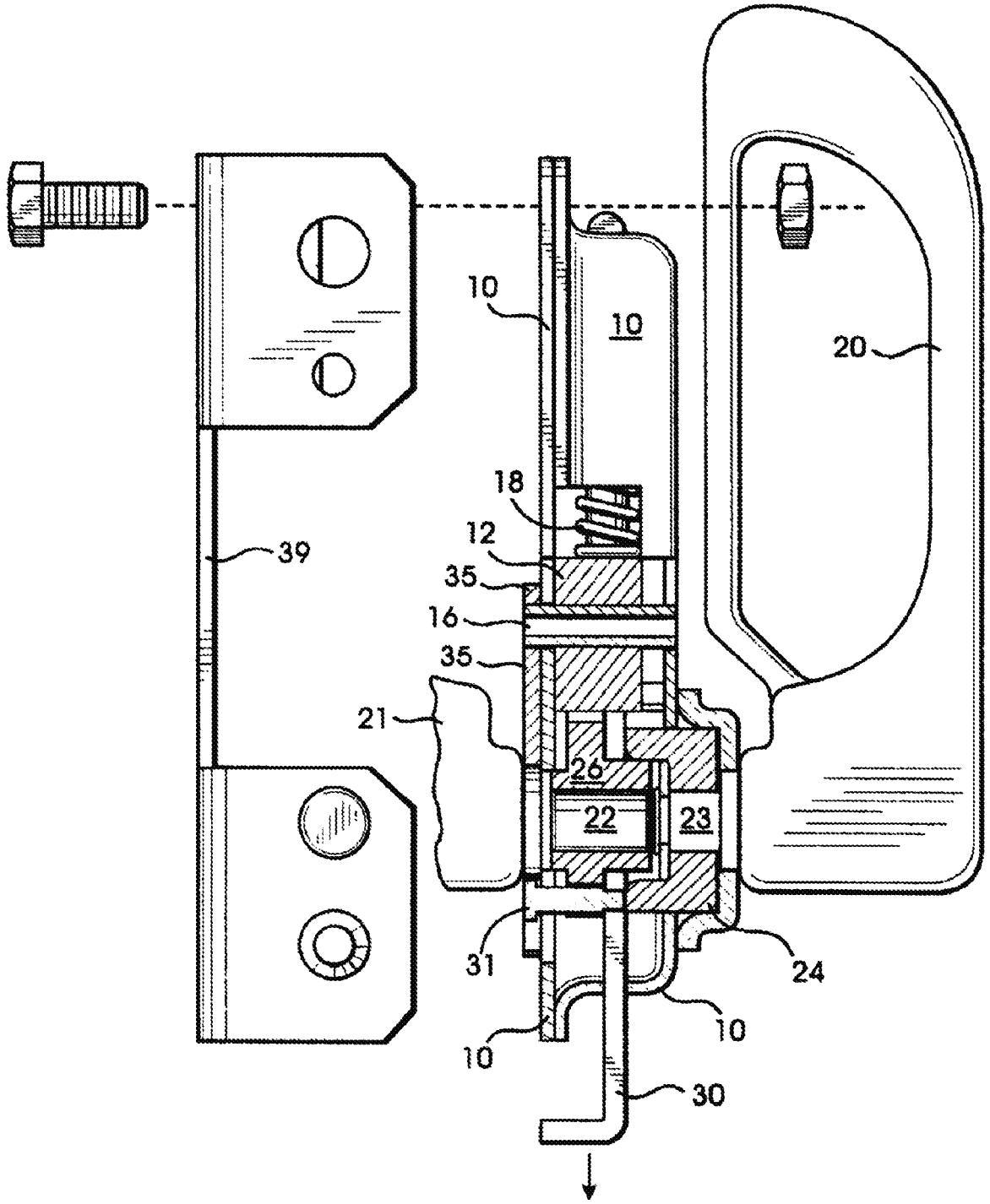
FIG. 2 (Prior Art)
FIG. 2 is a side view, partially in cross-section through plane 2-2, of the prior art latch assembly shown in FIG. 3 together with a mounting bracket.

The latch is equipped with both an inside handle 20 and an outside handle 21 that is shown broken away in FIG. 2. Each of these handles is provided to lift the latch catch off of a strike in unlatching the door to which it is mounted. The inside handle 20 has a shaft 23 which is rigidly mounted to an inboard cam 24 that has a cylindrical portion journalled in a housing bearing. In FIG. 2 the cam is shown out of camming engagement with the bottom of the latch bar 12. However, clockwise or counterclockwise rotation of the handle 20 and the inboard cam 24 brings the cam into camming engagement with the latch bar to one side or the other of the center pin 14. This causes the latch bar 12 to lift slightly and to cock, pivot, or rotate against the biasing force exerted by the closer of the two compression springs 18. Similarly, manual operation of the largely unshown outside handle 21 and its shaft 22 causes an outboard cam 26 to which it is rigidly mounted to move into camming engagement with the latch bar 12 independently of any operation of the inside handle 20.

Figure 3:
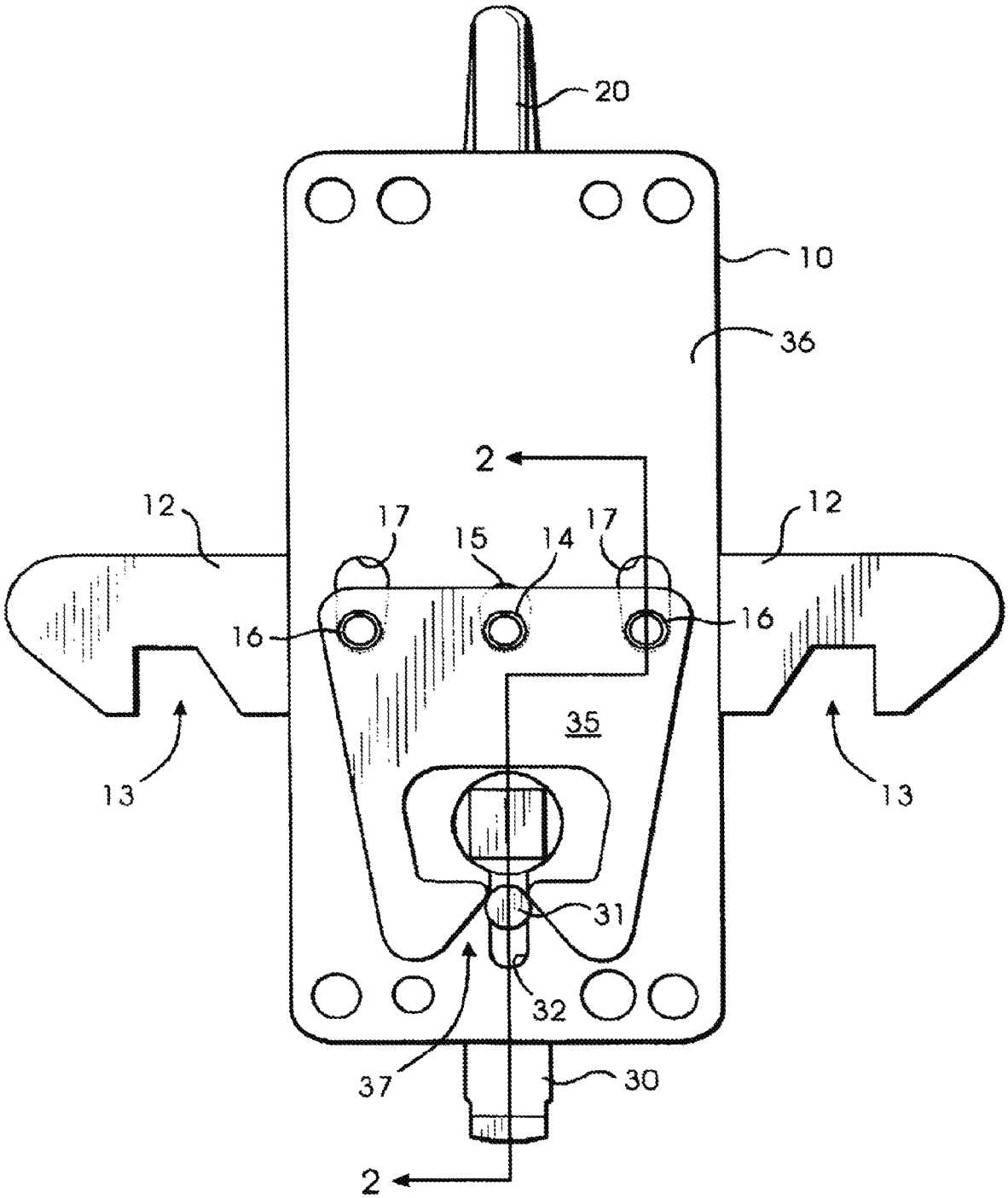
FIG. 3 (Prior Art)
FIG. 3 is a rear face view of the prior art latch assembly shown in FIG. 1.
Figure 4:
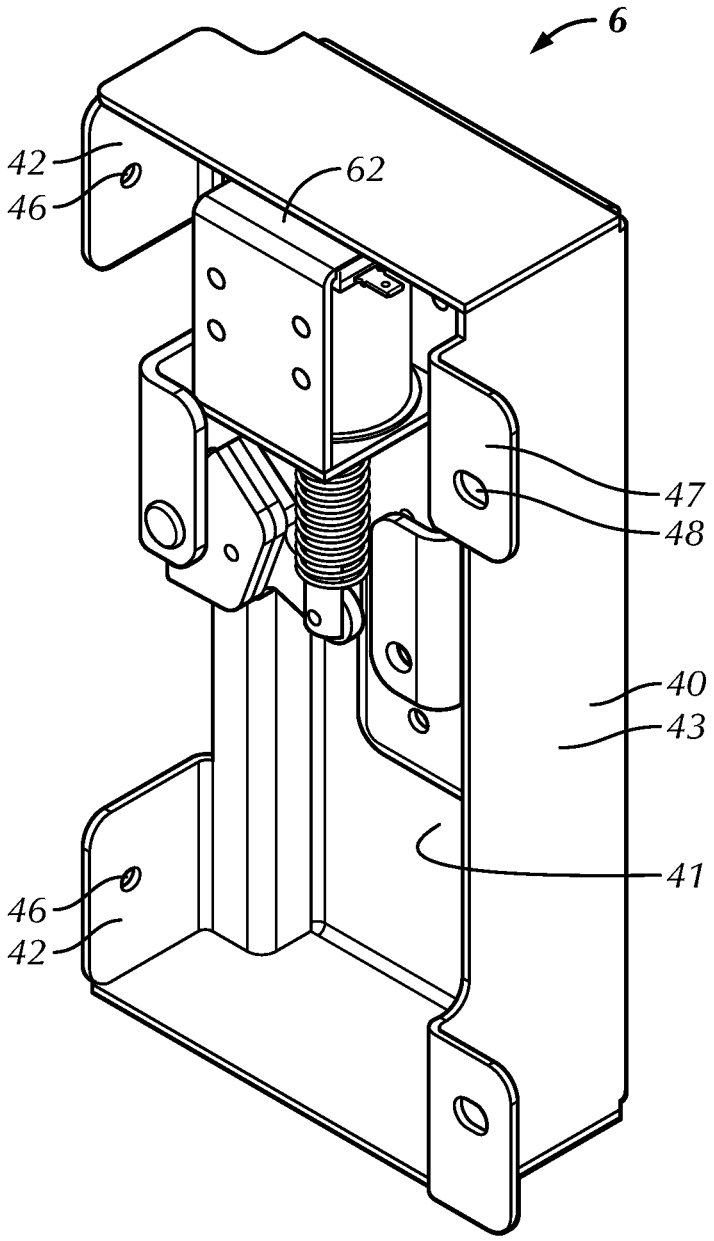
FIG. 4 is a perspective view of the lock assembly and strike assembly of the sliding door latch in a preferred form of the invention.
Figure 5:
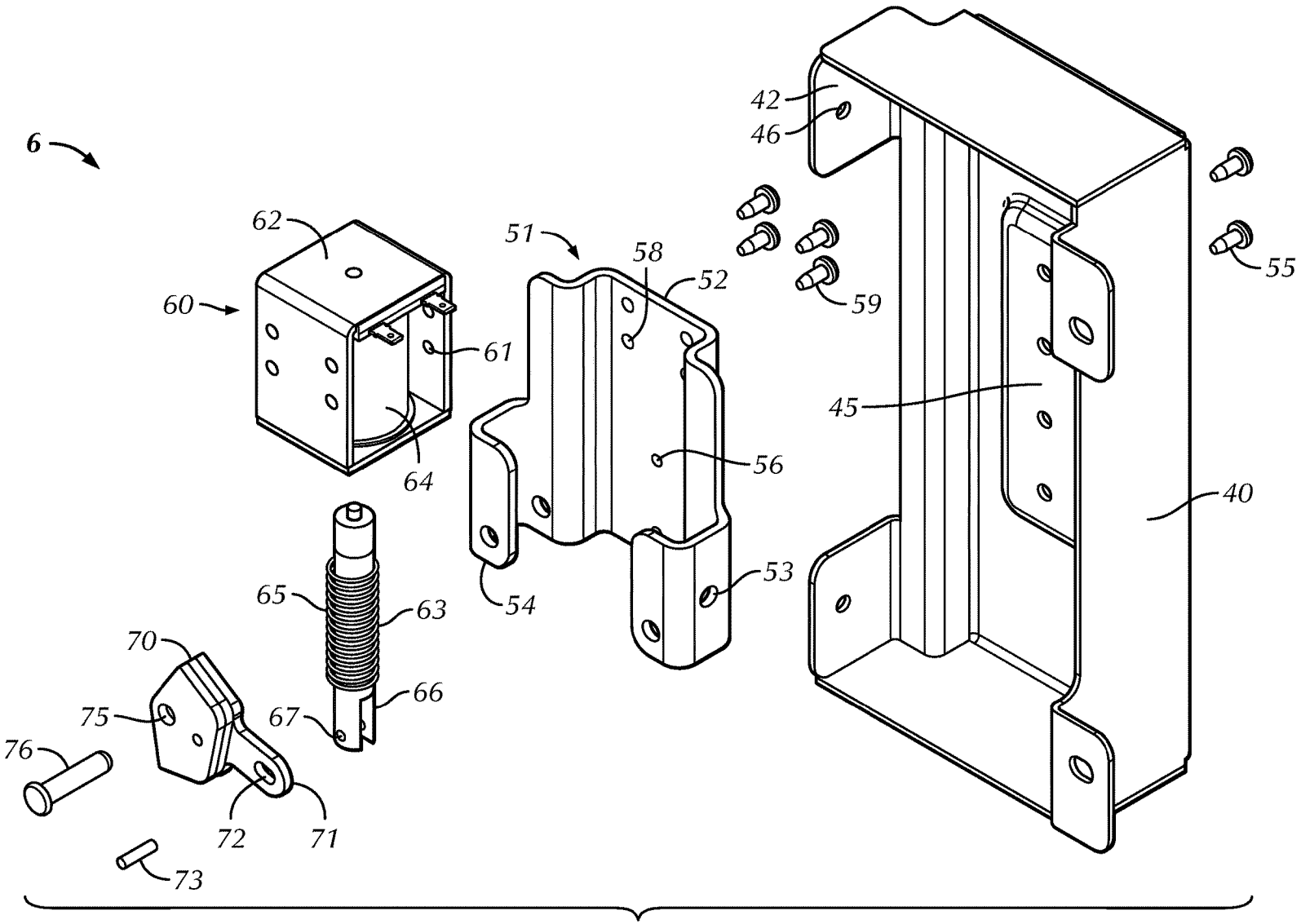
FIG. 5 is a perspective, exploded view of the lock assembly of FIG. 4.

The latch is provided with an optional means for manually locking the latch from the inside of a sliding door to which it is mounted to prevent the door from being unlatched from the outside. This locking feature is provided here by a lock bar or slide 30. The lock bar has a pin 31 that projects through a housing slot 32 that is shown in FIG. 3. The bar itself extends through a slot in the bottom of the housing and thus may be manually moved between its upper locked position shown in the drawing and a lower, unlocked position. The lock bar is mounted for reciprocal, vertical movement beside the inboard cam 24 into and out of a slot in the bottom of the outboard cam 26. In its up, locked position shown in the drawing, the lock bar, being partially positioned in the outboard cam slot, blocks the outboard cam from rotating. This renders the outside handle 21 useless in unlatching the latch until the lock bar 30 is manually pulled down from the inside. This can only be done of course if someone has access to it from the inside as the latch is mounted to the inside of a sliding door by a bracket 39 shown in FIG. 2.

The latch is further provided with an anti lock-out device in the form of a lock cancelling plate 35. The plate 35 is mounted to the center pin 14 for very limited rotary motion about it within a shallow recess in the back of the housing defined by a recess wall 36. The plate 35 has an inverted V-shaped channel 37 in its bottom. With the lock bar 30 in its raised, locked position shown in FIG. 3, its lock pin 31 engages the throat of the V-shaped channel of the plate 35. Should the latch bar 12 however rotate, which occurs when it becomes latched to a strike, one of the ramps that define the channel 37 of the cancellation plate 35 will cam the lock slide pin 31 down. This moves the lock slide 30 down and out of engagement with the outboard cam 26. With the lock slide disengaged from the outboard cam, the cam is free to be rotated by the outside handle 21 in unlatching the latch by lifting one side of the latch bar 12. Later, the lock slide may be again raised in locking the latch. Thus, anytime the latch bar engages a strike, latching the door in its fully opened or fully closed position, the lock bar is by that action alone disengaged from its locked position should it be in that position. In this manner it provides the latch with an anti-lockout feature.

The lock assembly 6 includes a lock assembly housing 40 having a rear wall 41, left wall 42, and right wall 43, with respect to the figures shown in the drawings. It should be understood that the truck has two such lock and striker assemblies, as a first assembly is to maintain the door secured in the door forward, latched position (forward lock assembly) and the second assembly is to maintain the door secured while in the door rearward, latched position (rearward lock assembly). Thus, the orientation of the structural elements of the lock and strike assembly are reversed from each other or mirror image between the two such assemblies, and the term left and right are interchangeable between the two assemblies. The rear wall 41 has a set of screw mounting holes 45 therethrough. The left side wall 42 has a pair of screw mounting holes 46 therethrough. The right side wall 43 has a pair of mounting flanges 47 having screw mounting holes 48 therethrough.

The lock assembly 6 also includes a solenoid housing 51 having a rear plate 52 from which extends two inwardly turned, L-shaped flanges 53, wherein each flange 53 has a front facing pin hole 54. The solenoid housing 51 is mounted to the lock assembly housing 40 through mounting screws 55 passing through mounting screw holes 45 and threadably received within screw holes 56 extending through rear plate 52. The rear plate 52 also has a set of four solenoid mounting screw holes 58 configured to receive solenoid mounting screws 59.

A solenoid assembly 60 is mounted to the solenoid housing 51 by threading the four solenoid mounting screws 59 through solenoid mounting screw holes 58 in the rear plate 52 and threading them into a solenoid casing screw holes 61. The solenoid casing 62 houses a solenoid 64 therein which is coupled to a d.c. power source and controlling electronics which may be mounted to locking assembly housing 40. In turn, the solenoid 64 includes a reciprocating drive or post 65 with a coil spring 63 for biasing the post 65 downwardly. The post 65 has a lower end with a collar or yoke 66 having pivot pin holes 67 therethrough. A generally trapezoidal shaped stop plate, stop, or dog 70 is pivotally coupled to the post collar 66 through an outwardly extending arm or flange 71 having a pivot pin hole 72 therethrough configured to receive a pivot or roll pin 73 which also extends through pivot pin holes 67. The dog 70 has a generally horizontal bottom contact surface 74. The dog 70 also has a second pivot pin hole 75 which is aligned with the pivot pin hole 54 of solenoid housing flanges 53 to receive a pivot pin 76 therein. As such, the dog 70 is pivotally coupled to both the solenoid housing flanges 53 and the solenoid post 65 for reciprocal movement between an engaged, contacting or locked position, shown in FIG. 6, and a disengaged, releasing or unlocked position, shown in FIG. 7.

The strike assembly 7 is mounted to the lock assembly 6 for latching engagement with the catch 13 of the latch assembly 5. The strike assembly 7 includes a main plate 80 having a pair of inwardly extending flanges 81 with mounting holes 82 therethrough which are aligned with holes 48 of rear wall flanges 47. Mounting screws 83 extend through holes 82 and are threaded into flange holes 48. The main plate 80 also has a strike plate portion or wall 85 having a pair of mounting holes 86 aligned with mounting holes 46 of the left side wall 42 of the lock assembly 6. Mounting screws or bolts 87 extends through the mounting holes 86 and are threaded into the side wall mounting hole 46. The strike plate wall 85 also has an indented area 88 with an opening 89 therein which creates a catch wall 90 with a top edge 91. Bolt mounting holes 92 extend through the strike plate wall 85 above and below the opening 89.

The strike assembly 7 also has a strike plate 94 with bolt mounting holes 95 aligned with bolt mounting holes 92 of the main plate 80. Mounting bolts 96 extend through bolt mounting holes 92 and 95 and are secured thereto with threaded nuts 97 in order to mount the strike plate 94 to the main plate 80. The strike plate 94 also has an opening 99 therethrough which is generally aligned with the opening 89 within the strike plate wall 85 of main plate 80. The strike plate opening 99 defines a top edge 100 which is generally just above or higher than the top edge 91 of the strike plate wall 85 of main plate 80.

Figure 6:
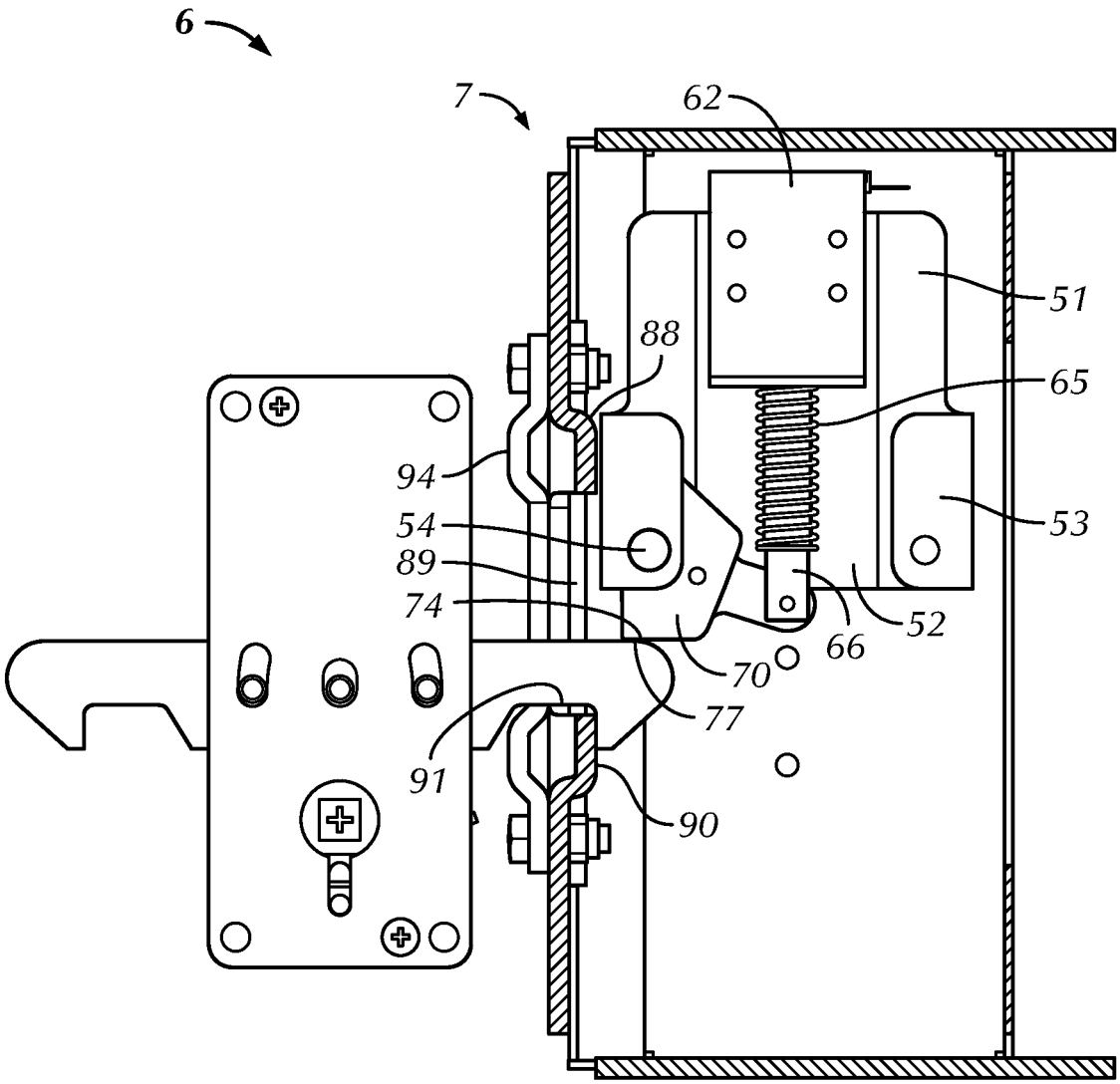
FIG. 6 is an inside face view of the prior art latch assembly shown with the lock assembly and strike assembly of FIG. 4, shown in a locked position.
Figure 7:
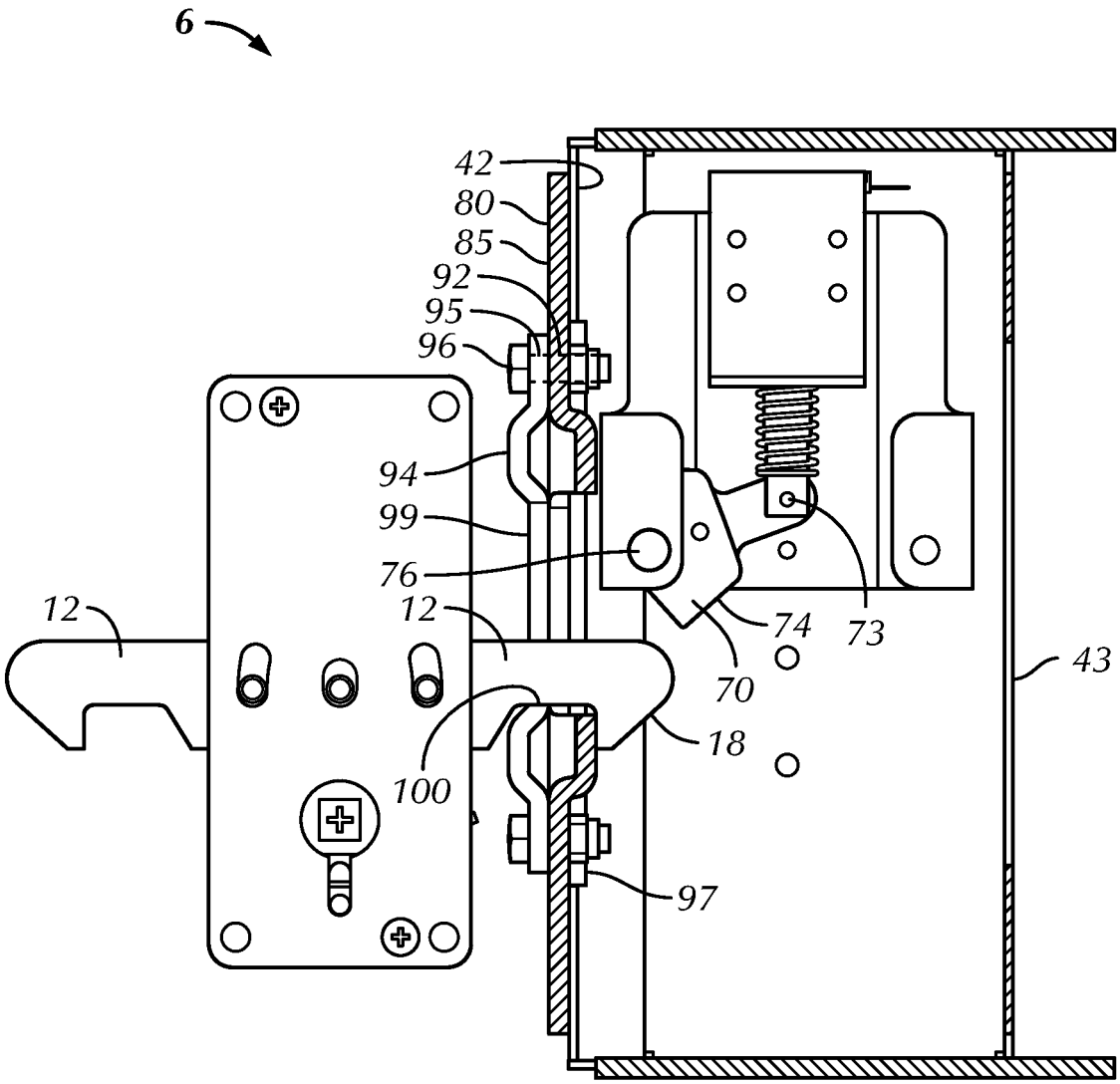
FIG. 7 is an inside face view of the prior art latch assembly shown with the lock assembly and strike assembly of FIG. 4, shown in an unlocked position.
Figure 8:
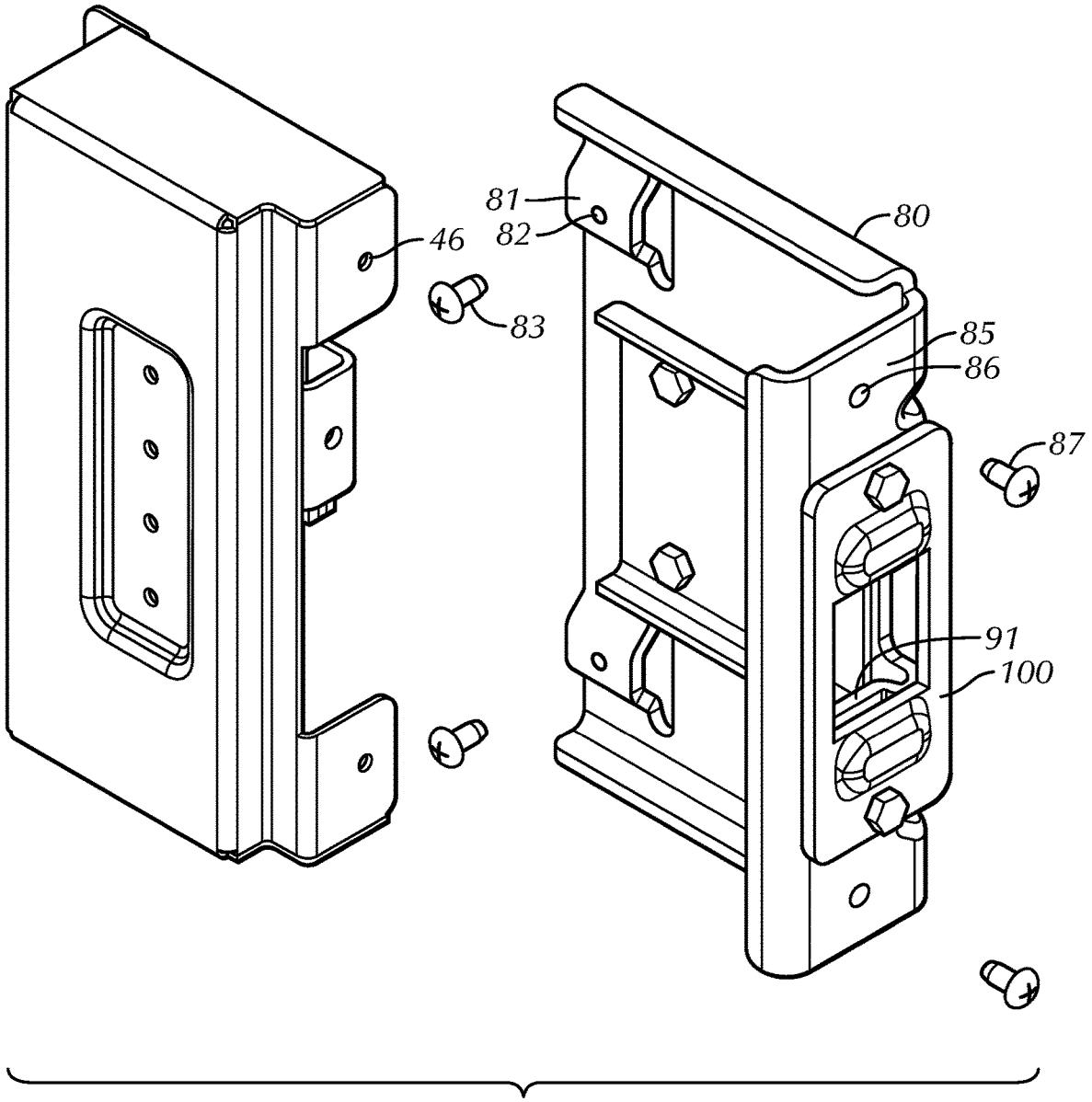
FIG. 8 is an exploded view of the lock assembly and strike assembly of FIG. 4.

In use, the vehicle door is slid to either the front extent or the rear extent of the run to latch the door in place. As the door approaches the end of the run, the latch bar sloped surfaces 18 contacts and rides up the top edge 100 of the strike plate 94 wherein the latch bar 12 then continues to ride over the top edge 91 of the catch wall 90 until the latch bar 12 falls downwardly so that the top edges 91 and 100 of the strike plate 94 and strike plate wall 85 resides or is captured within the notch 13 of the latch bar 12, as shown in FIG. 6, thus latching the door in place.

The inward movement of the latch bar 12 pushes upon the dog 70 causing it temporarily to rotate or pivot from its engaged/locked position to its disengaged/unlocked position. The pivotal motion of the dog 70 forces the solenoid post 65 upwardly, thereby compressing the solenoid spring 63. As the catch bar 12 comes to rest in its locked position, the dog 70 is pivotally pushed back down from its disengaged/unlocked position to its engaged/locked position by the biasing force of solenoid spring 63.

With the dog in its engaged/locked position, the dog's bottom surface 74 flushly abuts the top surface of the latch bar 12. The contact point or area 77 between the latch bar 12 and the dog bottom surface 74 is vertically aligned with the dog pivot pin 76, i.e., the pivot pin 76 is vertically aligned directly over the contact area 77. The term "vertically aligned" and "directly over" are intended to denote a position directly above and in alignment in the vertical direction, and is not intended to mean an alignment which is angled from the vertical. Therefore, any vertical force, or portion of such vertical force, upon the latch bar 12 is aligned with and transferred to the pivot pin 76 in a generally straight, vertical line perpendicular to the horizontal bottom surface 74. This configuration prevents the pivoting or rotation of the dog 70 by the vertical force or movement, which in turn prevents the ability of upward movement of the latch bar 12. By preventing the upward movement of the latch bar 12, the latch assembly 5 is prevented from disengaging or unlocking from the lock assembly 6, assuring that the vehicle door is maintained in either the door fully opened, latched position or the door fully closed, latched position.

When an operator wishes to open the latched door, the operator simply activates the electronic control circuit coupled to the solenoid 64. This electronic activation causes the solenoid to retract or vertically move the solenoid post 65 upwardly, which in turn causes the dog 70 to rotate about pivot pin 75 from its engaged/locked position to its disengaged/unlocked position. With the dog 70 in its disengaged/unlocked position, the latch bar 12 may be moved up through rotation of the inside handle 20 or outside handle 21. Now, the vehicle door may be moved from a door latched position to a door unlatched position.

It should be understood that the strike assembly 7 is not required to have two strike plates or portions, shown as strike plate wall 85 and strike plate 94, as the strike may be a single wall or plate.

It should be understood that the solenoid 64 may be, or termed, an electronic solenoid, a linear solenoid, an electro mechanical solenoid, a electronic-mechanical solenoid, or any other electrically activated solenoid.

It should be understood that the lock assembly housing 40 is generally symmetrical so that the same lock assembly housing 40 may be used for ease of manufacturing for both the forward and rearward lock assembly 6 of a sliding door vehicle, by simply inverting the lock assembly housing 40. Similarly, the solenoid housing 51 is generally symmetrical so that the dog 70 may be mounted to either flange 53 for use for both the forward and rearward lock assembly 6 of a sliding door vehicle.

It thus is seen that a latch for a vehicle sliding door is now provided with a locking assembly which automatically locks the latch to prevent the accidental opening of the vehicle door. It may of course be used on doors other than vehicle sliding doors. Indeed, while the locking mechanism has been shown and described in its preferred form, many changes, additions and deletions may be made thereto without departure from the spirit and scope of the invention as set forth in the following claims.

The invention claimed is:

1. A door latch locking assembly for use with a latch assembly having a vertically movable, elongated latch tongue having a pivot point at a first end, the locking assembly comprising, a lock housing;

a strike coupled to said lock housing for engagement with the latch tongue;

a solenoid coupled to said lock housing, and a pivotal dog coupled to said solenoid for pivotal movement between an engaged position positioned closely adjacent and directly over a second end of the latch assembly latch tongue distal from said pivot point for abutting contact with a top surface of said latch tongue of said latch assembly distal from said pivot point when the latch tongue is in a latched position engaging said strike and a disengaged position positioned distal the latch assembly latch tongue when the latch tongue is in a latched position engaging said strike.

2. The locking assembly of claim 1 wherein said dog has a bottom surface with a contact area between said dog and the latch tongue, and a pivot pin about which said dog pivots between the engaged position and the disengaged position, said pivot pin being positioned vertically over said contact area.

3. The locking assembly of claim 2 wherein said dog is pivotally coupled to said solenoid.

4. The locking assembly of claim 2 further comprising a solenoid housing coupled to said lock housing and said solenoid, said solenoid housing having at least one mounting flange, and wherein said pivot pin is coupled to said at least one mounting flange of said solenoid housing.

5. A door latch locking assembly for use with a latch assembly having a floating latch bar having a first end adjacent a pivot point of said latch bar and a second end distal said pivot point of said latch bar, the locking assembly comprising, a lock housing;

a strike coupled to said lock housing for latching engagement with the latch bar;

an electronic solenoid coupled to said lock housing, and a stop plate pivotally coupled to said solenoid for pivotal movement between a latch bar contacting position preventing the unlatching movement of the latch bar from said strike through abutment of said stop plate against the second end of said latch bar and a latch bar releasing position allowing unlatching movement of the latch bar from said strike.

6. The locking assembly of claim 5 wherein said stop plate has a bottom surface with a contact point between said stop plate and the latch bar, and a pivot pin about which said stop plate pivots between the contacting position and the releasing position, said pivot pin being positioned directly over said contact point.

7. The locking assembly of claim 6 wherein said stop plate is pivotally coupled to said lock housing.

8. The locking assembly of claim 6 further comprising a solenoid housing coupled to said lock housing and said solenoid, said solenoid housing having at least one mounting flange, and wherein said pivot pin is coupled to said at least one mounting flange of said solenoid housing.

9. A door latch locking assembly for use with a latch assembly having a vertically movable, elongated latch tongue with a top surface and a pivot point, the locking assembly comprising, a lock housing;

a strike extending from said lock housing for engagement with the latch tongue;

a solenoid having a reciprocating post, and a dog coupled to said solenoid reciprocating post for movement between an engaged position abutting and over the top surface of the latch assembly latch tongue located distally from said pivot point and a disengaged position positioned distal the latch assembly latch tongue.

10. The locking assembly of claim 9 wherein said dog has a bottom surface with a contact area between said dog and the latch tongue, and a pivot pin about which said dog pivots between the engaged position and the disengaged position, said pivot pin being positioned vertically over said contact area.

11. The locking assembly of claim 10 wherein said dog is pivotally coupled to said solenoid.

12. The locking assembly of claim 10 further comprising a solenoid housing coupled to said lock housing and said solenoid, said solenoid housing having at least one mounting flange, and wherein said pivot pin is coupled to said at least one mounting flange of said solenoid housing.

* * * * *